United States Patent [19]

Parent

[11] 4,090,621

[45] May 23, 1978

[54] APPARATUS FOR THE SUPERIMPOSED STORAGE OF VEHICLES

[76] Inventor: Jean-Claude Parent, Boulevard Piercot, 14, 4000 Liege, Belgium

[21] Appl. No.: 707,311

[22] Filed: Jul. 21, 1976

Related U.S. Application Data

[63] Continuation of Ser. No. 486,483, Jul. 8, 1974, abandoned.

[30] Foreign Application Priority Data

Jul. 9, 1973 Luxembourg ..... 67965
Nov. 11, 1973 Luxembourg ..... 68760

[51] Int. Cl.[2] ..... E04H 6/06
[52] U.S. Cl. ..... 214/16.1 ED; 214/16.1 E
[58] Field of Search ..... 214/16.1 R, 16.1 ED, 214/16.1 DA; 187/8.41, 8.71

[56] References Cited

U.S. PATENT DOCUMENTS

| | | | |
|---|---|---|---|
| 1,115,117 | 10/1914 | Shumway et al. | 187/8.71 |
| 1,288,567 | 12/1918 | Hall | 214/16.1 DA |
| 1,987,376 | 1/1935 | Stearns | 214/16.1 ED |
| 2,695,716 | 11/1954 | Graham | 214/16.1 ED |
| 2,815,872 | 10/1957 | Graham | 214/161 ED |
| 3,351,218 | 11/1967 | Garthoffner | 214/16.1 ED |
| 3,712,485 | 1/1973 | Klaus | 214/16.1 ED |
| 3,786,940 | 1/1974 | Klaus | 214/16.1 ED |

FOREIGN PATENT DOCUMENTS

| | | | |
|---|---|---|---|
| 262,204 | 1/1965 | Australia | 187/8.41 |
| 1,124,905 | 7/1956 | France | 214/16.1 ED |
| 1,124,411 | 7/1956 | France | 214/16.1 ED |
| 2,008,915 | 11/1971 | Germany | 214/16.1 ED |
| 903,307 | 8/1962 | United Kingdom | 214/16.1 ED |

*Primary Examiner*—Drayton E. Hoffman
*Assistant Examiner*—R. B. Johnson

[57] ABSTRACT

Apparatus suited for the vertically superimposed parking of a pair of motor vehicles including at least a first platform mounted for pivoting between a loading-unloading position and a position which permits access to a storage area located beneath the platform. The apparatus is characterized by the platform being mounted for pivoting about a geometric axis oriented transversely of the platform and located so as to impart a balance-like equilibrium to the entire platform assembly.

3 Claims, 5 Drawing Figures

FIG. 2a.
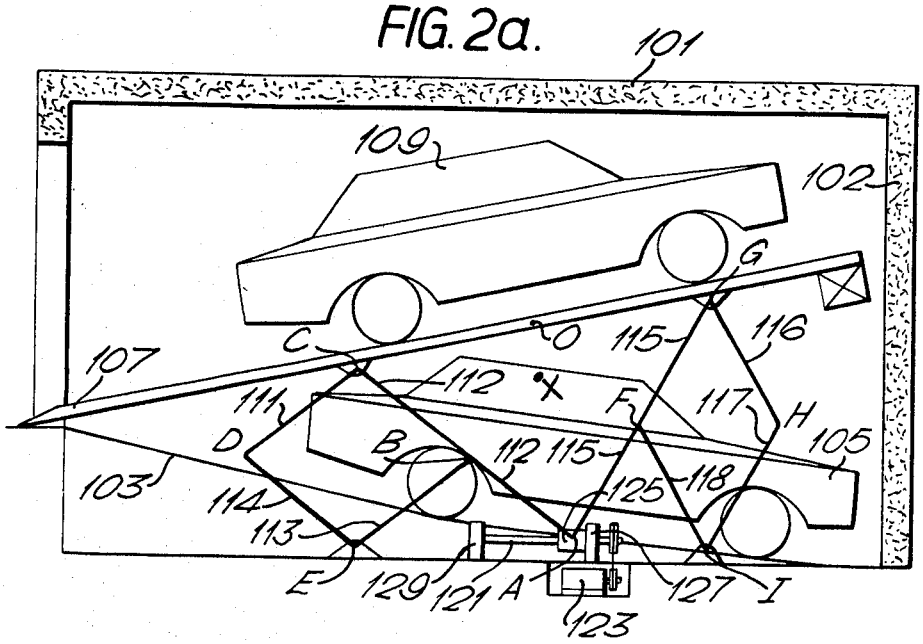
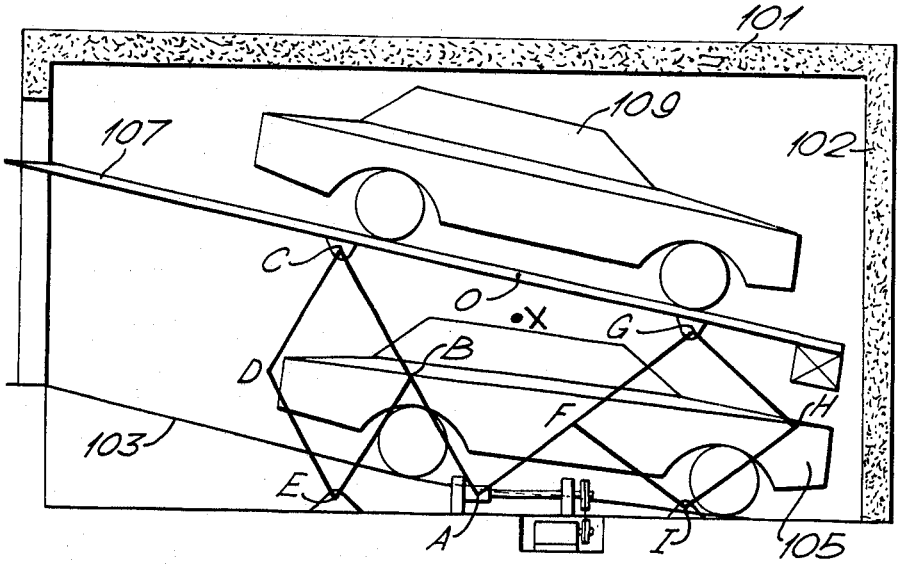
FIG. 2b.

FIG. 3a.
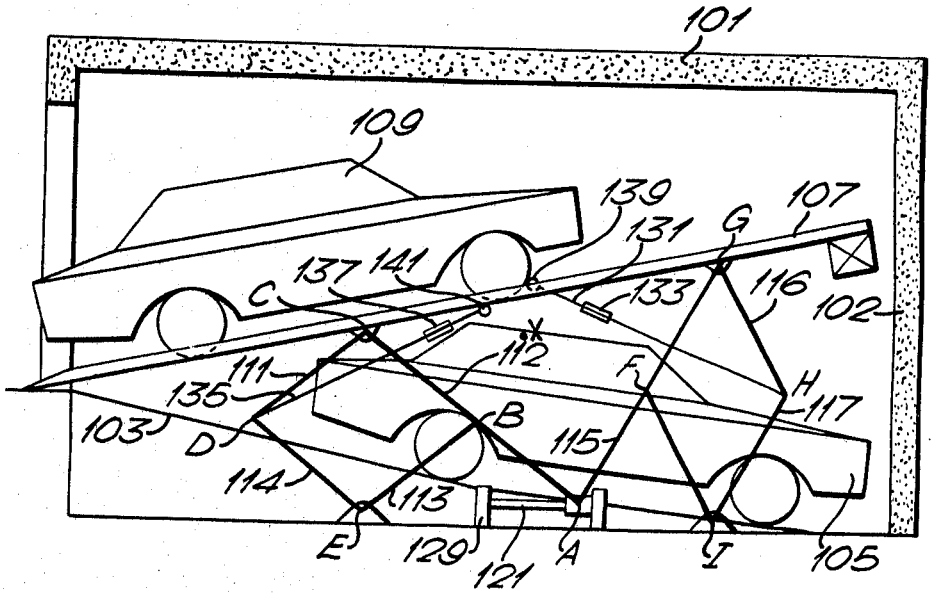
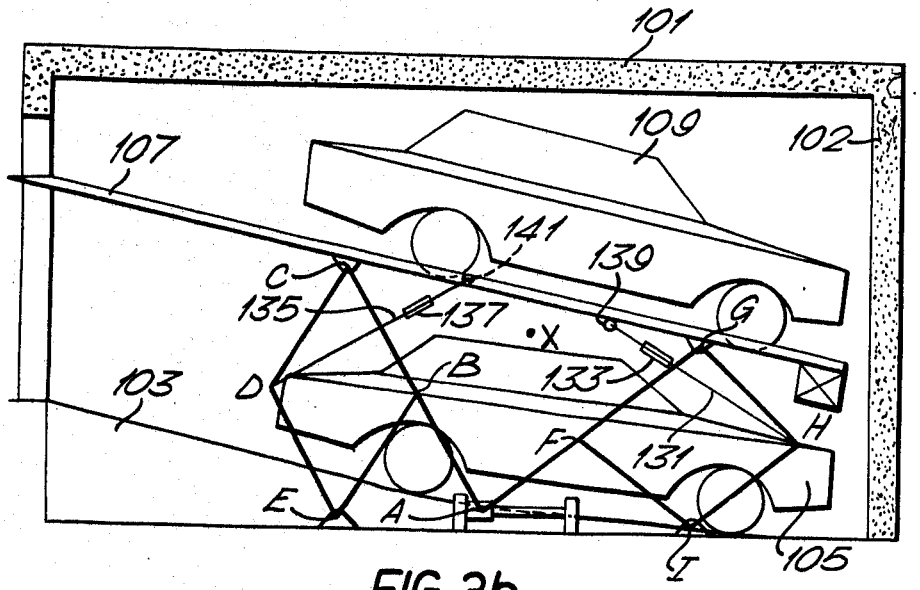
FIG. 3b.

APPARATUS FOR THE SUPERIMPOSED STORAGE OF VEHICLES

CROSS REFERENCE TO RELATED APPLICATIONS:

This application is a continuation of Application Ser. No. 486,483 filed July 8, 1974 and now abandoned. Application 486,483 claimed the benefits of the filing date of parent Luxembourg Applications Ser. Nos. 67,965 of July 9, 1973 and 68,760 of Nov. 11, 1976 and a similar claim for priroity is made in the present application.

BACKGROUND OF THE INVENTION:

1. Field of the Invention

The present invention relates to movable platforms and particularly to apparatus for use in the parking of vehicles. More specifically, this invention is directed to apparatus which permits the vertically superimposed storage of motor vehicles or other objects through use of at least a first movable platform which can be shifted between a loading-unloading position and a second position which affords access to a storage area beneath the platform. Accordingly, the general objects of the present invention are to provide novel and improved apparatus of such character.

2. Description of the Prior Art

While not limited thereto in its utility, the present invention is particularly well suited for use in the superimposed parking of pairs of motor vehicles. Numerous solutions to the long persistent problem of enhancing the volumetric efficiency of vehicular storage and parking facilites have been proposed and tried. Typical of the prior art solutions to this problem are platforms affixed to a pivot spindle anchored in a wall at the end opposite to the access end of the platform. In such devices a hydraulic jack causes pivotal movement of the platform between a down position, wherein a vehicle may be driven above a lower garaging space, and an upper position permitting access by a second vehicle to the lower garaging space.

There are also prior art devices in which a parking platform or ramp comprises, on either side of a lower storage space, a pair of legs pivoted at one end to the lateral edges of the platform. The opposite ends of such legs are connected to the ground by means of second pivot connections whereby the legs can rotate about either a common or closely spaced axes. In such apparatus the two legs disposed on each side of the platform, together with the portion of the platform between the pivot connections of the platform to the legs, define a triangle which has its apex pointed downwardly toward the ground. Under the influence of a hydraulic jack or other powerful mechanism, swinging movement can be imparted to such a triangular apparatus thus causing the platform to move between an up and down position. The pivot point of the triangle, being situated on the ground, is below the center of gravity of the movable platform assembly in such apparatus.

All prior art movable parking and storage platforms which permit superimposed stacking require significant power to impart upward displacement to the platform; this being particularly true when a vehicle is parked thereon. Conversely, during downward displacement, it is necessary for the weight of the movable platform apparatus and the vehicle to be restrained by appropriate braking means. Accordingly, previously available apparatus has employed hydraulic jacks. As is well known, such jacks and their associated pumps are quite heavy. Further, such hydraulic control appartus requires skilled and specialized personnal for erection and maintenance. Thus, prior art movable platform type parking and storage devices have been characterized by high initial cost and comparatively high operating and maintenance expenses.

A further disadvantage of prior art movable platform devices resides in the fact that, in the case of a failure in the hydraulic circuit or other power producing equipment, manual control is almost impossible and, at the very least, a considerable period of time is required to manually displace the platform to free the vehicles.

SUMMARY OF THE INVENTION

The present invention overcomes the above briefly described and other deficiencies and disadvantages of the prior art by reducing the power necessary for displacing a movable platform between its operative positions. In accordance with one embodiment of the invention, particularly designed for the superimposed parking of two motor vehicles, movement of a platform with respect to a lower parking area is effected solely by displacement of the vehicle thereon.

A movable platform apparatus in accordance with the present invention comprises at least a first movable platform capable of pivoting between two extreme positions about a geometric axis transverse to the platform. The apparatus is characterized by the axis, about which the platform pivots, being located so as to bring about a balance-like equilibrium of the platform and any additional components displaced by the movement thereof. Additionally, the geometric pivot axis is disposed above the center of gravity of the movable assembly.

Apparatus in accordance with the present invention is characterized by ease of manual control and thus does not require hydraulic jacks or other control mechanisms of comparatively large size and weight and a relatively high degree of complexity and thus reliability.

In accordance with a further embodiment of the invention a movable platform pivots about an axis or spindle disposed exactly on the geometric transverse pivot axis. In accordance with another embodiment of the invention the movable platform is mounted on a pivoted system which causes an equivalent movement of the platform in relation to the geometric axis.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which:

FIGS. 2*a* and 2*b* comprise a schematic side elevation view of a second embodiment of the present invention, the embodiment of FIG. 2 including a pivotal platform shifted in position by means of a control motor; and FIGS. 3*a* and 3*b* comprise a schematic side elevation view of a further embodiment of the invention, the embodiment of FIG. 3 differing from that of FIG. 2 by means by which shifting of the single movable platform is accomplished.

DESCRIPTION OF THE PREFERRED EMBODIMENTS

Figure 1:
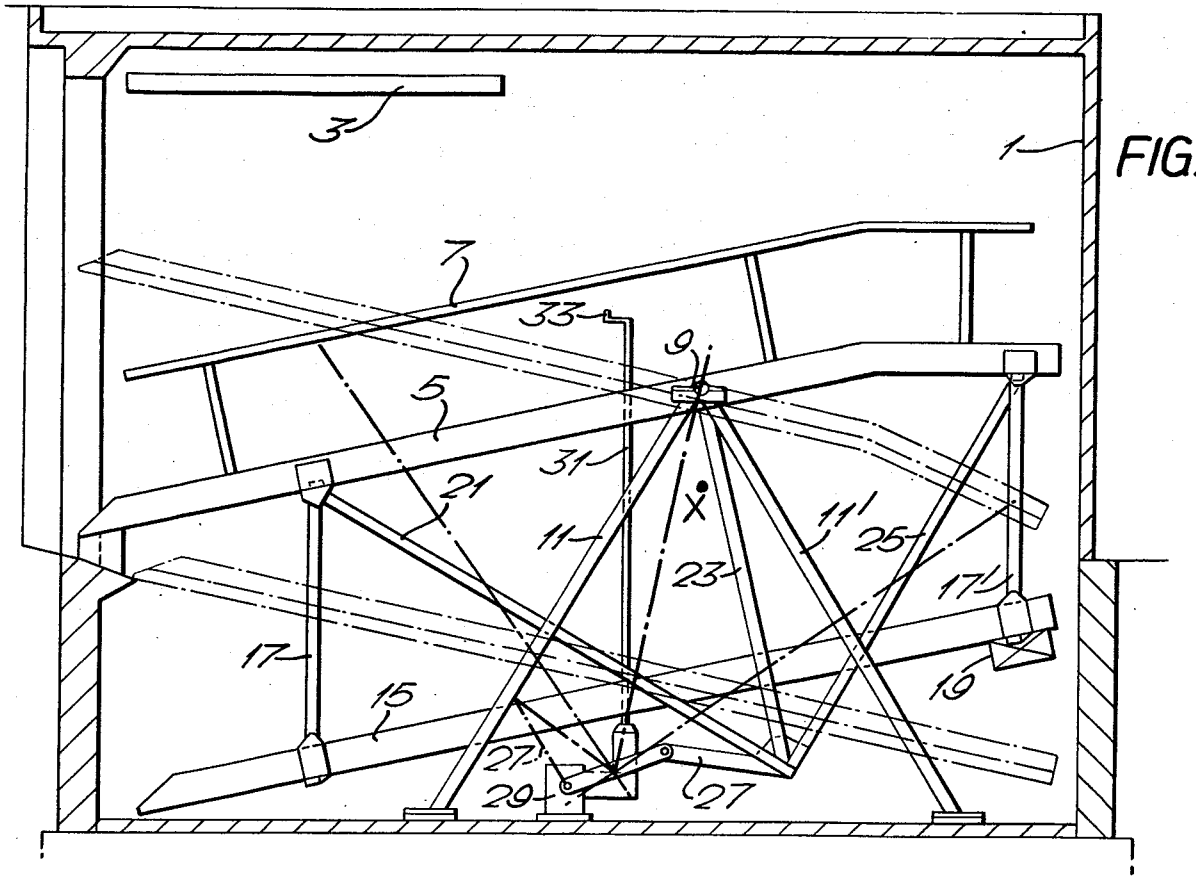
FIG. 1 is a side elevation view of a first embodiment of apparatus in accordance with the present invention, the apparatus of FIG. 1 including a pair of platforms which pivot in unison about a common geometric axis of the entire platform assembly.

With reference now to FIG. 1, the rear wall of a housing, for example a garage structure, is indicated at 1. The garage is provided with a swinging door 3 which cooperates with the access opening whereby the interior of the structure may be isolated from the elements and secured against intruders. It will, of course, be understood that the movable platform apparatus of the present invention need not be employed within a garage structure but rather may be used in an outdoor parking facility.

The platform apparatus comprises a first or upper platform 5 which is provided with guardrails such as rail 7. The entire apparatus including platform 5 is capable of pivoting motion about an axis or spindle 9 on bushings or bearings which have not been shown in the drawing. The spindle 9 is supported at its oppositely disposed ends by means of pairs of legs such as the legs 11 and 11'; the pairs of legs being disposed on either side of the platform apparatus and being firmly anchored to the ground at their lower ends.

In the FIG. 1 embodiment a second or lower platform 15 is suspended from upper platform 5 by means of four tie rods; the rods 17 and 17' at a first side of the apparatus being shown. The tie rods 17 and 17' are coupled to the sides of platforms 5 and 15 adjacent the oppositely disposed ends thereof. Coupling of the tie rods 17 and 17' to the platforms is accomplished by means of pivot joints and thus the ties remain vertically oriented when the upper platform 5 is moved; the lower platform 15 being carried with the upper platform during displacement thereof. When the apparatus is empty; i.e., in the absence of vehicles on either or both of the platforms; the center of gravity, as indicated at x, of the apparatus including platforms 5 and 15 and their interconnecting elements is situated below the pivot axis defined by spindle 9.

The pivot axis; i.e., the spindle 9; is positioned such that the entire platform assembly, which may include a counterweight 19, is in equilibrium in the manner of a balance. Further, when vehicles are disposed on either or both of platforms 5 and 15, the center of gravity $x$ of the apparatus shifts so as to be at a reduced distance from the geometric axis of spindle 9. Accordingly, the force which must be generated by control apparatus used in shifting the platforms from the position shown in solid lines to the position shown in broken lines and vice-versa in comparatively small.

In order to effect movement between the two positions; i.e., from the platform apparatus position shown in solid lines which affords vehicle access to platform 5 to the position shown in broken lines which afords vehicle access to platform 15 and vice-versa; side members 21, 23 and 25 are provided on each side of the apparatus. The side members 21, 23 and 25 are connected at first ends to upper platform 5 and the lower ends of the side members are interconnected. As may be seen by comparing the position of the platforms as shown in solid and broken lines in FIG. 1, the connections between side members 21 and 25 and platform 5 are rigid. The point of interconnection of side members 21, 23 and 25 is, by means of a pivot, coupled to a drive motor 29 by means of a linkage 27. The linkage 27 may be driven by motor 29 from the position shown in solid lines to that shown in broken lines. During the driven movement of linkage 27, becuase of the construction of the apparatus, the apparatus will initially move at a very slow speed, the movement will continue while accelerating to a maximum velocity and a speed of movement will reduce as the apparatus approaches its second or opposite limit of motion.

The balancing of the platform apparatus, as discussed above, greatly reduces the power necessary to shift the apparatus from a first to a second operative position. Thus, it is possible to disconnect motor 29 and to effect manual displacement of the assembly through the intermediary of a removable rod 31 and handle 33 should motor 29 for any reason fail in service.

FIGS. 2*a* and 2*b* depict a second embodiment of the invention which comprises a single movable platform 107. Platform 107 is depicted as being disposed within a garage 101, 102 comprised of concrete. The garage is provided with a fixed platform 103 which may be employed for the parking of a lower vehicle as indicated at 105. In the manner to be described below, the movable platform 107 can be swung, with or without a vehicle 109 parked thereon, from the position shown in FIG. 2*a* to that shown in FIG. 2*b* to provide free acess to the lower platform 103 and the vehicle 105 thereon. The platform 107 is pivoted, during movement, about a geometric axis O. In the interest of reducing the transverse clearance required when compared to the FIG. 1 embodiment, a pair of pantograph assemblies is disposed on either side of platform 107 in the FIG. 2 embodiment.

The first of the aforementioned pantograph assemblies is comprised by four side members 111, 112, 113 and 114. The second pantograph assembly is defined by side members 115, 116, 117 and 118. There are, of course, identical pantograph assemblies, not shown, connected to the second or rearwardly disposed side of platform 107. The side members 112 and 115 of the pantograph assemblies are longer than the remaining side members which are themselves of identical length. The side members 112 and 115 are interconnected at a pivot point A. The other pivot points of the pantograph assemblies are indicated by reference characters B, C, D, E, F, G, H and I. The pivot points C and G are fixed to the lateral sides of platform 107 while the pivot points E and I are, by any suitable means, attached to the ground so as to maintain the spacing E-I constant. The four sides of each pantograph assembly thus, in the manner well known in the art, form deformable parallelograms and the two longer pantograph side members and a portion of platform 107 cooperate to define an isosceles triangle. In the disclosed embodiment the thus defined triangle is an equilateral triangle. During shifting of platform 107 from the position shown in FIG. 2*a* to that of FIG. 2*b* the pivot point A will undergo linear movement. The platform 107, which rests on a suspended and inverted triangle C, G, A, will pivot about the geometric axis O.

Due to its unique design the platform apparatus of FIG. 2 is substantially in equilibrium. The combination of this equilibrium and the linear movement of the pivot point A greatly reduces the power required to displace platform 107; the power required being primarily that necessary to overcome frictional forces. It will, of course, be realized that due to the positioning of a vehicle on platform 107 the equilibrium position of the assembly and vehicle is not always perfectly realized. However, as the result of the particular concept of the suspended triangle, even when a vehicle is not located exactly in the equilibrium position the operating force necessary to cause displacement of platform 107 is greatly reduced when compared to prior art apparatus of like character. Should it be considered desirable that the vehicle 109 be placed precisely at the equilibrium position, a measuring device can be located at the point of articulation A so as to measure, as a function of the displacement of the vehicle, the forces exerted at point A. Obviously means can be provided which will permit the driver to follow the measuring of the forces imposed at pivot point A to thereby enable the driver to move his vehicle precisely to the point of equilibrium.

The displacement of point A; i.e., the shifting of platform 107; can be controlled by means of an adjusting screw driven by a motor. Such an adjusting screw is indicated at 121 driven by motor 123; the pivot point A displacing itself linearly along the screw through the intermediary of a nut 125 to which the side members 112 and 115 are pivotally connected.

A pair of stops, indicated in FIG. 2*a* at 127 and 129 limit the travel of drive nut 125 and consequently limit the movement of platform 107. As noted above, the means for suspending and supporting platform 107 will be identical on both sides of the platform. However, it is not necessary to provide means for driving the pivot point A at both sides of the platform.

It may be noted that in the embodiment of FIG. 2 the side members 111, 114, 116 and 117 of the pantograph assemblies are included only to impart rigidity to the platform apparatus. Accordingly, it is possible to eliminate these four side members provided that the remaining elements have sufficient mechanical strength.

The embodiment of the invention shown in FIGS. 3*a* and 3*b* is identical to that of FIGS. 2*a* and 2*b* with the exception of the fact that the screw 121 is not driven by a motor. Thus, in the FIG. 3 embodiment, the movement of platform 107 is effected by the vehicle 109 present on the platform. To this end a pair of rod assemblies drivingly interconnect platform 107 with respective of the pantograph assemblies. A first of these rod assemblies comprises a rod 131 which slides in a bushing 133. A first end of rod 131 is pivotally connected to pivot point H of one of the pantograph assemblies while the second end of rod 131 is provided with a roller 139. The second rod assembly comprises a rod 135 which slides in a bushing 137. Rod 135 is, at its first end, pivotally connected to pivot point D of the other pantograph assembly. The second end of rod 135 is provided with a roller 141. In the "down" position, as shown in FIG. 3*a*, the roller 139 overlaps the driving path constituted by platform 107 and roller 141 is retracted below the driving path. In the "up" position of FIG. 3*b* the reverse is true. The movement of rods 131 and 135, guided by the respective bushings 133 and 137, results in the deformation of the pantographs as shown. The shifting of the platform from the position of 3*a* to that of 3*b* is effected by displacement of vehicle 109; the front wheels of the vehicle pressing the roller 139 and thus transmitting force to pantograph FGHI via rod 131. The reverse movement of platform 107 effected by the force exerted by the same front wheel on roller 141 and rod 135. As will be obvious to those skilled in the art, if desired a brake can be provided on screw 121 to prevent platform 107 from moving too rapidly.

The FIG. 3 mode of control, as described immediately above, is only possible in accordance with the teachings of the present invention wherein the platform assembly is balanced. A particular advantage of the present invention resides in the fact that, with the exception of possible security stops, nothing interfers with movement of either the upper or lower vehicle toward the front or rear of the platform assembly. Thus, referring to FIGS. 2 and 3, the rear wall 102 of the garage may be removed whereby vehicle 109 can exit from the parking platform by driving forwardly over a fixed ramp extension of platform 107.

While the present invention has been described in the environment of a facility for superimposed parking of motor vehicles, the invention may also be employed as an equalizer for quays. Thus, the platform 107 may be employed to connect a loading quay of constant height to the load carrying portion of a vehicle having a variable height in accordance with the type of vehicle and its load. Also, in the embodiment shown in FIGS. 2 and 3, wheels may be attached to pivot points E and I and suitable structural members can be provided interconnecting these points to preserve a constant spacing or to possibly permit adjustment of the spacing.

Accordingly, while a preferred embodiment has been shown and described, various modifications and substitutions may be made thereto without departing from the spirit and scope of the invention. Thus, it is to be understood that the present invention has been described by way of illustration and not limitation.

What is claimed is:

1. Apparatus for use in the superimposed storage of vehicles comprising:

housing means, said housing means defining an enclosed storage area;

a first pivotal platform including a pair of oppositely disposed ends, a pair of sides, and a geometric axis located intermediate said oppositely disposed ends and passing through said sides;

leg means mounted within said storage area and including means for pivotally supporting said first platform at said axis;

a second platform, said second platform including oppositely disposed ends and sides;

means pivotally suspending said second platform beneath said first platform whereby said second platform will move with said first platform;

a pair of elongated side members connected at their respective first ends to each side of said first platform, said side members being operative to facilitate movement of said platform between a first operative position wherein a first end of said first platform is positioned for receiving vehicles and a second operative position wherein the first end of said first platform is disposed above the said vehicle receiving position and a first end of said second platform is positioned to receive a vehicle to be stored, said side members being connected to each side of said first platform at a pair of points spaced on opposite sides of said geometric axis;

means connecting the second ends of said side members to a common point below at least a portion of said second platform;

counterweight means mounted on said second platform, said geometric axis and points and counterweight means being located so as to place said first and second platforms substantially in an equilibrium balanced position in either of their operative positions with the said geometric axis located above the center of gravity of the combination of said first and second platforms;

a source of mechanical power, said power source having a displaceable output member; and means interconnecting said power source output member and said second ends of said side members, said interconnecting means transmitting pivotal motion to said first platform via said side members whereby said first platform is caused to pivot about said geometric axis between said first and second operative positions.

2. The apparatus of claim 1 further comprising:

spindle means affixed to said first platform, said spindle means being disposed on said geometric axis.

3. The apparatus of claim 2 wherein said leg means comprises:

at least a pair of arms on either side of said first platform, said arms of said pairs extending between said spindle means and said housing means.

* * * * *